US005775979A

United States Patent [19]

Coke et al.

[11] Patent Number: 5,775,979

[45] Date of Patent: Jul. 7, 1998

[54] ENCLOSED ABRASIVE BLASTING APPARATUS

[76] Inventors: Dan A. Coke, 1362 Brookmark SE., Grand Rapids, Mich. 49508; Douglas R. Coke, 6291 Wing Ave. SE., Grand Rapids, Mich. 49512

[21] Appl. No.: 735,004

[22] Filed: Oct. 22, 1996

[51] Int. Cl.[6] ..... B24C 9/00

[52] U.S. Cl. ..... 451/87; 451/354; 451/89; 451/88

[58] Field of Search ..... 451/75, 87, 88, 451/89, 91, 92, 434, 354, 344

[56] References Cited

U.S. PATENT DOCUMENTS

| | | | |
|---|---|---|---|
| 2,810,991 | 10/1957 | Mead et al. | 451/88 |
| 3,307,296 | 3/1967 | Ashworth | 451/88 |
| 3,548,541 | 12/1970 | Miller | 451/75 |
| 3,705,565 | 12/1972 | Hammelmann | 451/75 |
| 4,232,487 | 11/1980 | Brown | 451/88 |
| 4,286,417 | 9/1981 | Shelton | 451/92 |
| 4,409,920 | 10/1983 | Hammelmann | 451/75 |
| 4,825,598 | 5/1989 | Schlick | 451/75 |
| 5,138,800 | 8/1992 | Janusz | 451/92 |
| 5,231,805 | 8/1993 | Sander | 451/88 |
| 5,367,841 | 11/1994 | Smith et al. | 451/89 |
| 5,489,234 | 2/1996 | Hockett | 451/87 |
| 5,529,530 | 6/1996 | McPhee et al. | 451/87 |
| 5,545,074 | 8/1996 | Jacobs | 451/87 |

*Primary Examiner*—Timothy V. Eley
*Assistant Examiner*—Derris H. Banks

[57] ABSTRACT

An enclosed abrasive blasting apparatus for a ship hull or other working surface comprises a movable and adjustable boom and an enclosed operator containment mounted on the end of the boom. The containment has a top, sides, back, bottom, and an adjustable angle open front with a peripheral gum rubber seal that is placed against the working surface. The outlet nozzle for the abrasive blasting system is positioned within the containment where the operator directs the abrasive stream against the working surface. A waste collection system creates a negative pressure in the containment that seals the containment against the working surface, while at the same time directing an airflow stream from an inlet in the top of the containment downwardly across the working surface, entraining waste particles proximate to the working surface into the airflow stream, and further directs the waste particles to a sealed collection container below the enclosure. The heavy abrasive particles fall by gravity and settle out in the collection container for re-use while the lighter dust and waste particles are drawn off and separated in a dust collector operated by a centrifugal vacuum fan.

14 Claims, 5 Drawing Sheets

ENCLOSED ABRASIVE BLASTING APPARATUS

FIELD OF INVENTION

This invention relates to abrasive blasting systems for the removal of paint from a large surface such as the hull of a ship, and more particularly to an enclosed abrasion blasting system mounted on a movable boom that removes, collects and separates the used abrasive, removed paint chips, and the dust associated with the abrasive blasting process.

BACKGROUND OF THE INVENTION

Abrasive blasting, often referred to as sandblasting, is a well known method of removing layers of old coatings, such as paint, from various surfaces and for preparing these surfaces to receive a fresh coating. One application for which this process is particularly well suited is the removal of old paint from the exterior surface of a ship's hull while the ship is in dry-dock for refitting and refurbishment. In the past, this process has generally been accomplished in an open air environment, with the dust being carried away by the prevailing air currents and the used abrasive and paint chips falling to the floor of the dry-dock to be collected and disposed of in a similar manner as other waste materials. However, as times have progressed, environmental laws, regulations, and knowledge of the hazardous nature of some of the materials in coatings have now required the implementation of stricter measures for the collection, control, and disposal of such waste.

Numerous systems for abrasive blasting exist in the art, both as custom designed applications and as standard commercially available systems for performing this operation. Typically, the blasting apparatus comprises a reservoir of an abrasive such as steel grit or steel shot and a high pressure delivery system, whereby the delivery medium is either water or air, with air delivery being the most common. The delivery medium and abrasive are transferred through a hose to a working end such as a nozzle. The nozzle may be hand held or fixed to a remotely controlled mechanical mechanism. The working end is positioned in proximity to the surface from which the old coating is desired to be removed. As the abrasive is delivered under pressure through the nozzle, the abrasive stream attains a relatively high velocity, thereby creating an abrasive action between the abrasive and the coating to be removed. The abrasive action removes the coating in chips and particles of various sizes which, along with the abrasive particles, become waste or are reprocessed to extract the abrasive for further use in the blasting process, leaving the removed coating particles as waste. Recycling can provide a significant cost savings with some abrasives, such as steel grit or steel shot, which can be used over and over again if they can be separated from waste material.

Abrasive blasting systems for cleaning ships' hulls are well known in the art. In such systems, the abrasive blasting mechanisms often are operated at an end of a telescoping tower or boom. The operator may direct the blasting process from a position located remote from the working surface of the ship, or the operator may be positioned on a platform at the end of the boom adjacent the surface of the ship and may handle the blasting nozzle manually.

In open blasting operations, the blasting process produces paint chips, abrasive blasting media and other relatively large waste particles that fall to the ground or in the water. The process also produces a significant amount of waste in the form of a fine dust, which is suspended in ambient air and dispersed away from the working surface by ambient air currents. This dust is unlike the larger particles, which fall to the ground under the influence of gravity, because the dust tends to float in the air. This impairs collection and presents an environmental hazard to the blast nozzle operator and to the surroundings.

An object of the present invention is to provide an enclosed abrasive blasting system for ships' hulls and the like which effectively encloses an operator platform at the end of a man lift boom and contains and collects both dust particles and larger solid waste particles produced during the blasting process.

SUMMARY OF INVENTION

The present invention relates to an abrasive blasting system having an enclosed operator platform and enclosed collection apparatus for the collection of used abrasive, removed paint chips, and dust generated during the blasting process.

The present invention comprises apparatus for abrasive blasting a working surface wherein the apparatus comprises a movable and adjustable boom having an end adapted to movement in both a lateral plane and a vertical plane. A rigid enclosure or containment is attached to the end of the boom and is sized to accommodate a human operator. The containment has an open front, with a movable front frame attached to the enclosure frame. The movable frame desirably is pivotable about an upper end. The boom facilitates placement of the open front of the enclosure against the working surface. The movable frame includes an adjustment mechanism accessible to the human operator for adjusting and retaining the front frame at any pivoted position between the fully retracted and fully extended position.

A cover that is substantially air impermeable covers the enclosure sides, back and top. The cover over the enclosure top has a portion which is air permeable. A substantially air impermeable conical enclosure bottom has an opening for the discharge of waste particles. A flexible, substantially air impermeable covering extends between the enclosure frame and the front frame, permitting the front frame, when movable, to be pivoted between a retracted position and an extended position. The movable frame makes it possible to adjust the plane of the front of the enclosure so that it can be placed flush against the side of a work surface having a varying angle of inclination, such as a ship's hull.

A gum rubber seal is attached to the front frame around the open front such that the seal provides a substantially airtight seal between the working surface and the enclosure.

The enclosure or containment is used with a commercially available abrasive blasting system, wherein the nozzle and a position of the hose is positioned within the enclosure for directing an abrasive stream onto the working surface. The nozzle is held and so directed by a human operator located inside the enclosure.

In the collection system, a two cubic yard dumpster is positioned below the enclosure. The dumpster has an enclosed top, with an inlet in the top connected to the outlet of the bottom of the enclosure and an outlet in the top leading to a conventional dust collector unit. The steel grit or shot and other heavy particles fall directly into the dumpster, while a centrifugal vacuum fan in the dust collector draws air and entrained dust particles downwardly through the enclosure and then through the closed dumpster to the filter and dust collection apparatus of the dust collector. The dust and much of the removed paint is drawn through the dumpster to the dust collector, while the steel grit or steel shot and only the heaviest paint chips remain in the dumpster. This makes it possible to reuse the abrasive, which saves expense.

The air permeable ventilation panel in the front of the top of the enclosure ensures a downward air flow across the work surface that draws dust particles away from the operator and restrains release of dust particle of the atmosphere. The ventilation panel is a mesh fabric having an area and permeability such that the blower produces a relatively strong negative pressure in the enclosure which restrains dust loss through cracks and urges a good air tight seal between the containment and the ship hull. The panel, however, provides sufficient ventilation that a strong downward air flow is produced through the containment. The air flow should be between about 4500 and 7500 cubic feet per minute and preferably about 5000–6000 cubic feet per minute.

These and other features, aspects, and advantages of the present invention will become better understood with regard to the following description, appended claims, and accompanying drawings.

DESCRIPTION OF PREFERRED EMBODIMENT

Figure 1:
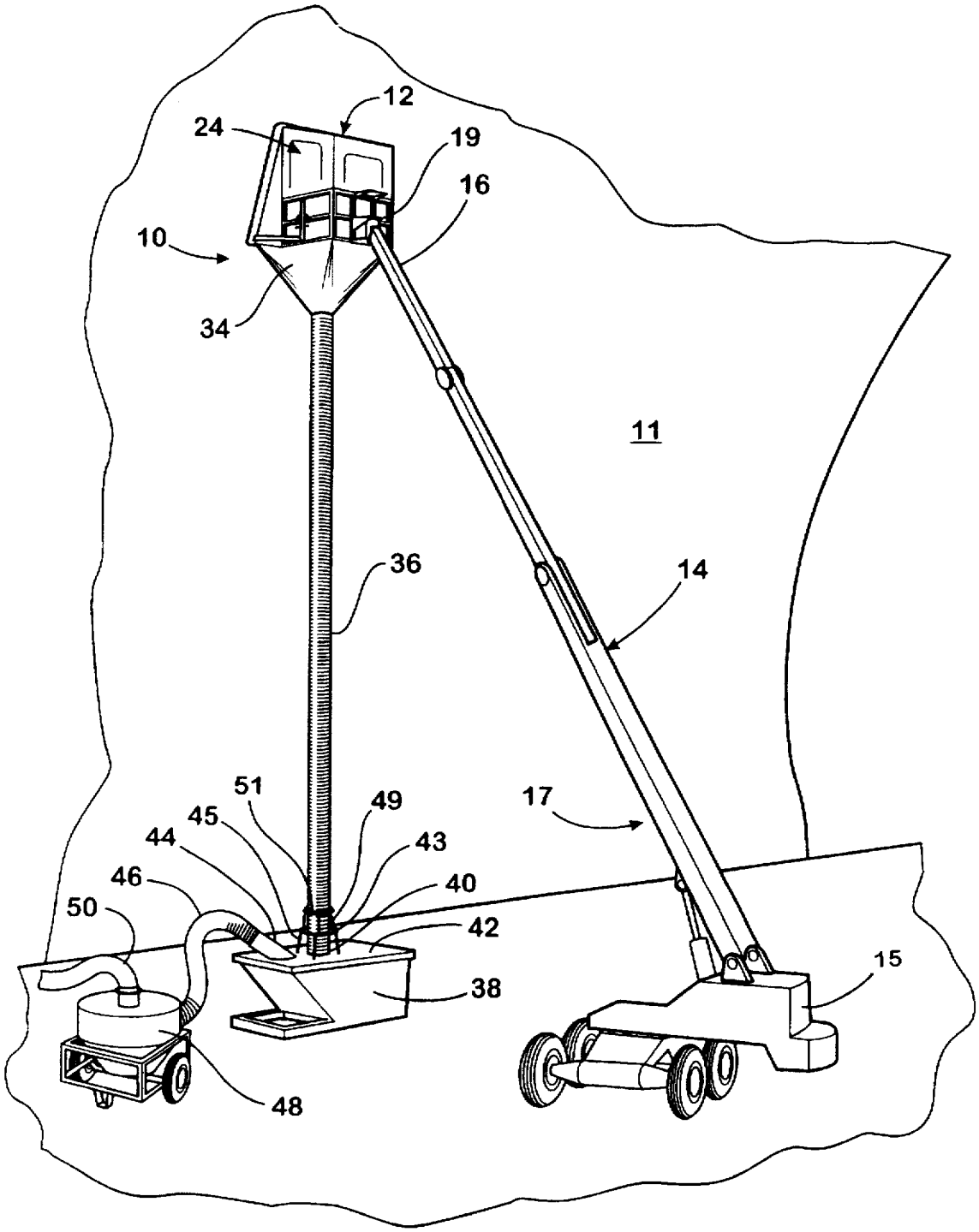
FIG. 1 is a pictorial view showing the abrasive blasting system of the present invention positioned against a ship hull.

Referring now to the drawings, and to FIG. 1 in particular, an abrasive blasting system 10 for a ship's hull 11 according to the invention comprises an enclosure or containment 12 for placement against a ship's hull 11. The enclosure 12 is mounted to a distal end 16 of movable and adjustable boom 14 mounted on a wheeled base 15 of a conventional manlift 17. Boom end 16 is attached to the back of the enclosure by a pivot bracket 19, which permits pivotal movement of the enclosure in both a lateral plane and in a vertical plane.

The telescopic boom 14 of manlift 17 supports an enclosure frame 22 (FIG. 3) formed of rigid structural members. The frame is enclosed by a cover 24, which desirably is formed of a durable fabric that is substantially air impermeable, having zipper opened windows 26 on sides 25 and back 27 of the enclosure and having an air permeable panel 28 in a top 30. Air permeable inlet panel 28 is adjacent the front of the enclosure. In a typical system the air permeable inlet panel is formed of a mesh fabric having an impermeability rating of about 90%. The panel size typically is about 7.5 feet long and one foot wide.

A generally conical downwardly and inwardly tapered bottom cover 34 is connected to the bottom of the frame and leads downwardly to an outlet conduit 36 (desirably a fourteen inch diameter hose) that extends downwardly to a container 38, which is a two cubic yard dumpster, where it enters an opening 40 in a closed (sealed) top 42 of the dumpster. The funnel desirably is formed of vinyl or other durable fabric.

A raised ring 43 mounted on legs 45 surrounds the lower end 47 of the hose, which desirably is a collapsible corrugated material. Elastic cords 49 attach to a raised rib 51 in the hose. The elastic cords and raised rim cause the hose to collapse neatly over the dumpster inlet 40 when the enclosure is lowered, thus providing a means to automatically shorten and lengthen the hose as the enclosure is raised and lowered and thereby continue to provide a straight path from the enclosure to the dumpster.

An outlet 44 in the top of the dumpster is connected to a conduit 46 that leads to a dust collector 48 of conventional design. The outlet desirably is a rigid inclined outlet tube. This minimizes hose kinking. Dust collector 48 employs a high volume centrifugal fan and filter system that draws air and entrained dust and paint particles from the dumpster to the dust collector system, then removes the dust and paint particles from the air and discharges the cleaned air to atmosphere by outlet conduit 50. The spent media is relatively heavy and for the most part falls to the bottom of the dumpster. Most paint particles are evacuated to the dust collector, so the media in the dumpster is fairly clean and can be reused with or without additional cleaning. This saves a substantial amount of money.

An advantage of this system is that a separate pump system is not necessary in order to collect heavy particulate materials. With the dumpster positioned directly below enclosure 12, the heavy particulate materials fall downwardly under the influence of gravity through conduit 36 directly into dumpster 38. The centrifugal fan of vacuum dust collector 48 draws a negative pressure in the dumpster, causing airflow from the dumpster through outlet 44. This causes a downward airflow from the enclosure to the dumpster through conduit 36. This produces a high volume downward airflow across the work surface from the inlet panel 28 in the top 30 of the enclosure downwardly through the bottom of the enclosure. The air and entrained dust particles exit the enclosure also through conduit 36, but the dust particles and high volume of air necessary to convey the dust particles are drawn off of the top of the dumpster through outlet 44 and conduit 46, leaving the heavy particulate materials to collect in the dumpster. With this construction, a single outlet conduit and a single dust collector pump suffices to collect and separate heavy particulate materials and dust. The only requirement for this system is that it must be possible to position the dumpster below the enclosure, so that heavy particulate materials will be conveyed to the dumpster by gravity. The use of a sealed two yard dumpster is important. This size of dumpster provides a rate of air flow through the dumpster that causes dust and lighter waste particles to be entrained in the air flowing through the dumpster, while the airflow is sufficiently low that the valuable steel abrasive settles out in the dumpster with only a minor portion of heavy waste particles. The dumpster can easily be removed for emptying and replaced with an empty dumpster when filled.

The use of a dust collector with a centrifugal vacuum fan also is important. This fan sets up a desirable negative pressure in the enclosure, while ensuring a sufficiently high rate of air flow to draw dust and smaller particles all the way to the dust collector. A fan having a capacity of 4500–7500 cubic feet per minute (CFM) is adequate to produce the desired vacuum and airflow and separate the lighter from the heavier particles. An air flow rate of 5000–6000 CFM is desired.

Figure 3:
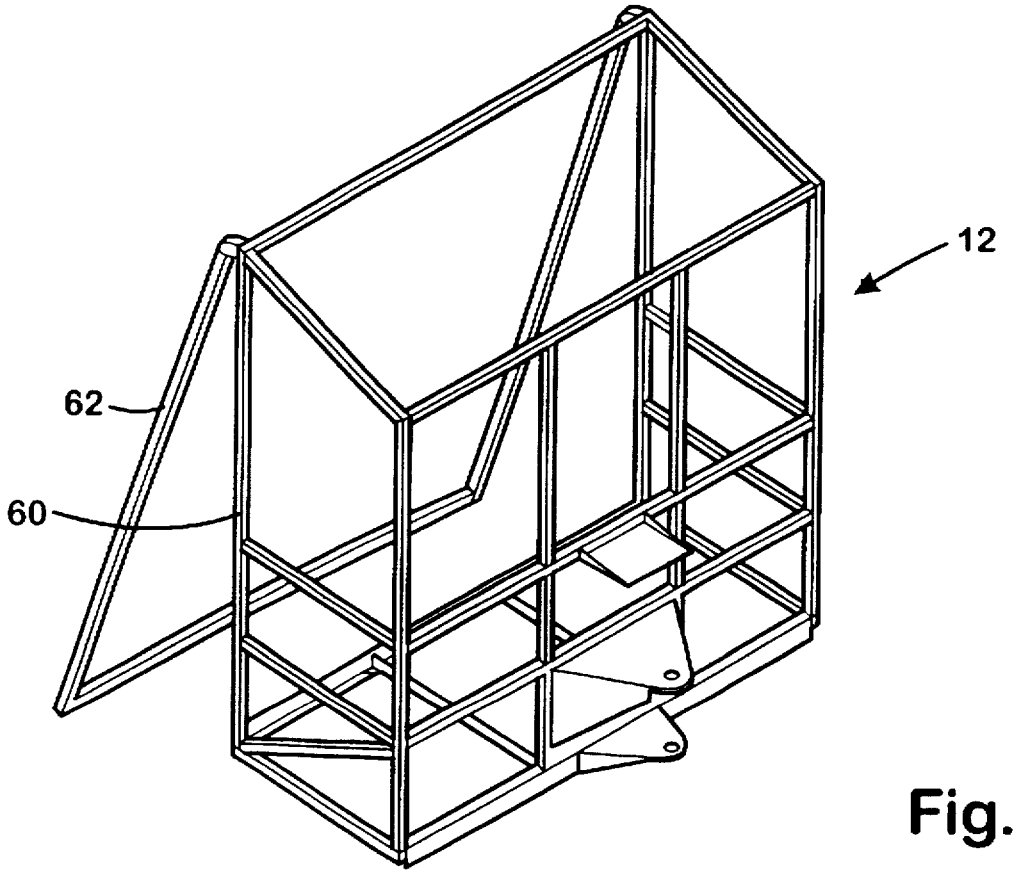
FIG. 3 is a perspective view of the frame of the enclosure of FIG. 1.
Figure 4:
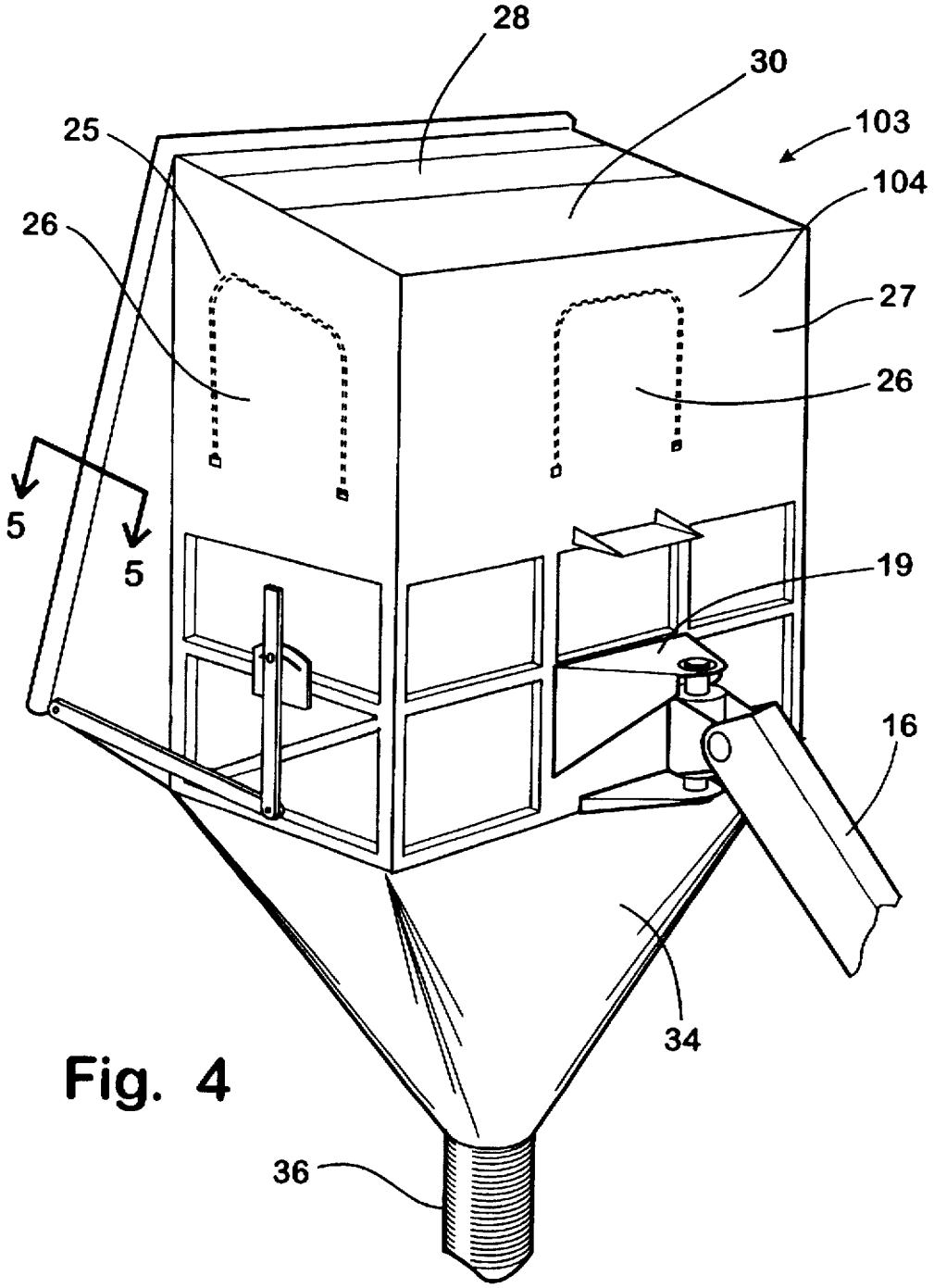
FIG. 4 is a perspective view of the covered enclosure of FIG. 1.
Figure 6:
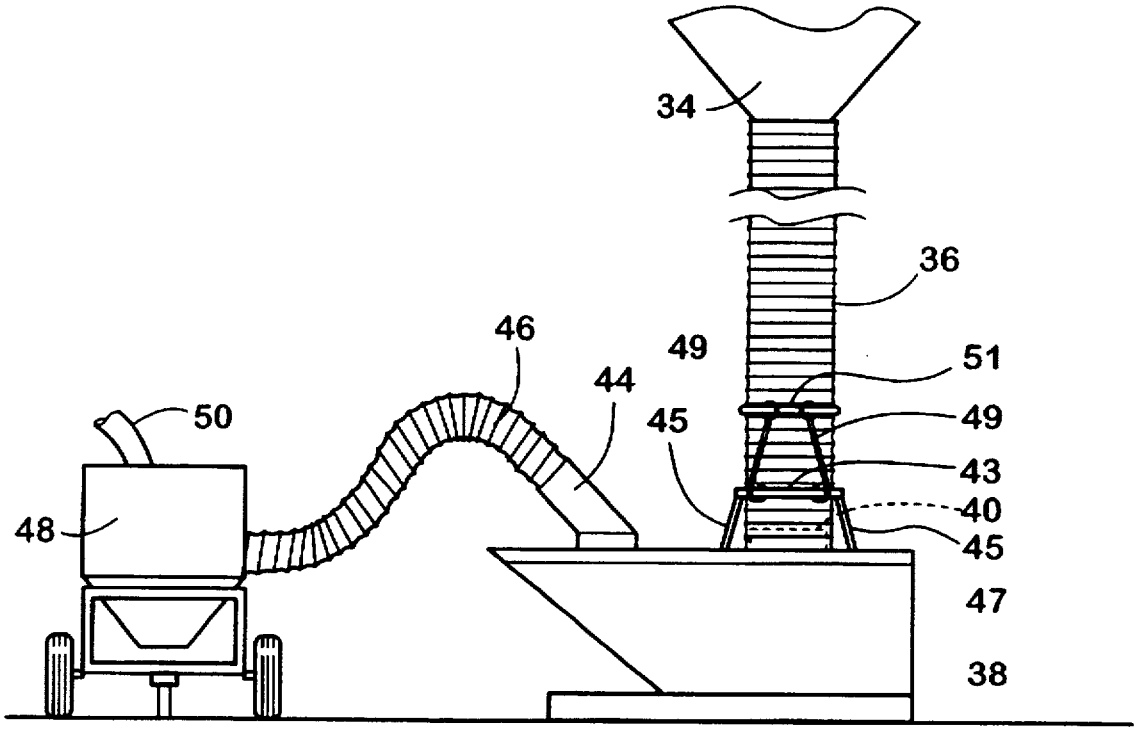
FIG. 6 is a side elevational view of the dumpster collector of the present invention.

The construction of enclosure frame 22 is shown in FIG. 3. The frame is generally rectangular and has an open front 60 that faces the working area on the hull surface. A movable front frame 62 is pivotably mounted on front 60 of the fixed frame by pivot hinges 64 at the top thereof. The lower end of the front frame is maintained in a desired position by means of an adjustment mechanism 66 mounted on the side of the frame. Adjustment mechanism 66 comprises a lever arm 68 pivotally mounted by a pivot pin 70 to a plate 72 on a cross bar 74 on the side of the frame. A second pin 76 aides in an arcuate slot 78 in plate 72. Pin 76 can be a bolt having a wing nut fastener or the like so as to be able to lock lever 68 at any given angular position in the slot. The lower end of lever arm 68 is attached to an arm 80 that extends outwardly and is attached at the lower end of front frame 62.

Figure 2:
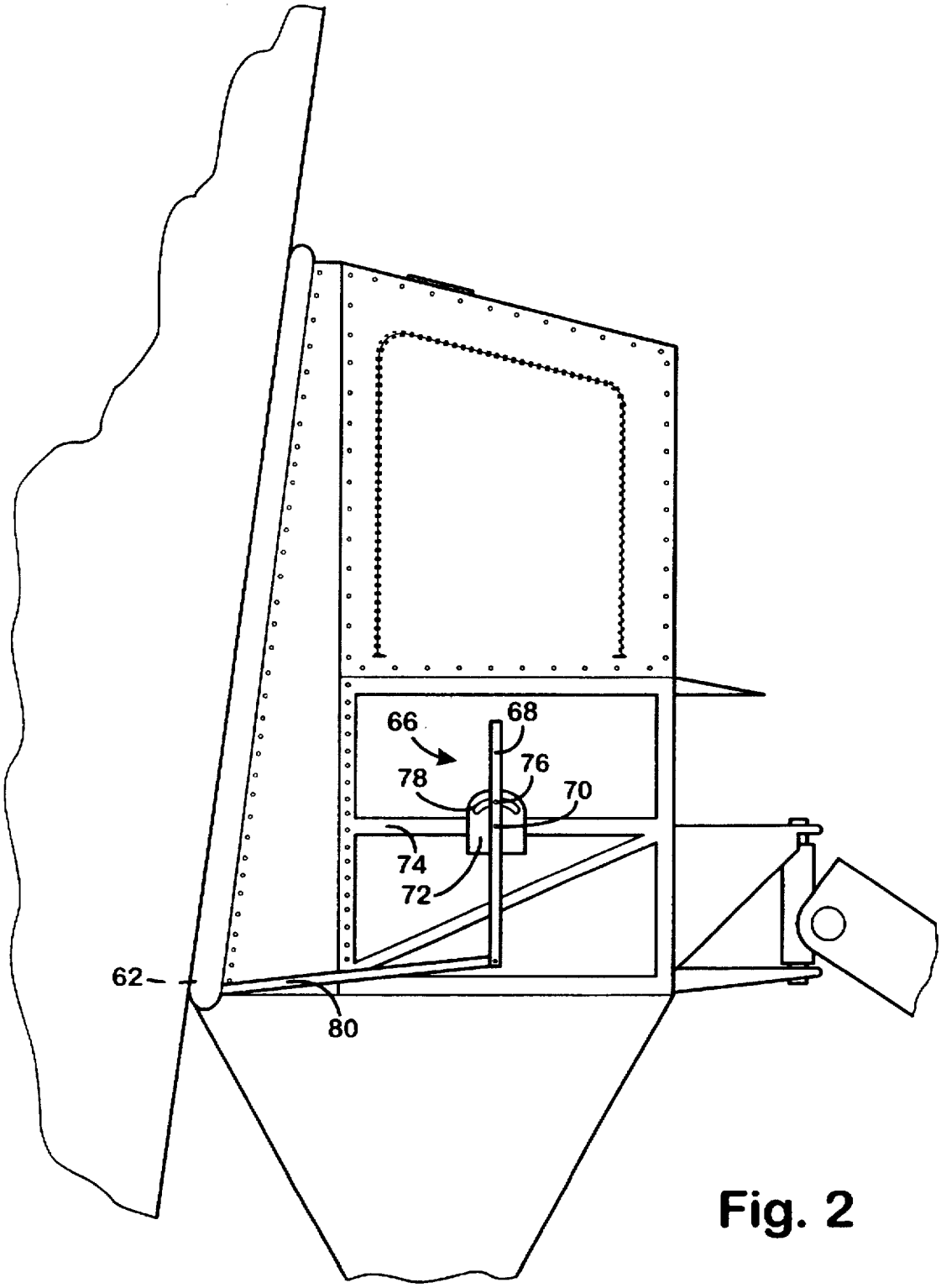
FIG. 2 is a side elevational view of the enclosure of FIG. 1.

As shown in FIG. 2, front frame is pivotal outwardly in order to adjust the front of the enclosure to an inclined surface of a hull. Since the inclination of the side of a ship hull varies from the top to the bottom of the hull, it is necessary to have the front frame pivot outwardly and inwardly to match the hull inclination at any given working area so as to provide a tight seal between the enclosure cover or containment and the surface of the ship.

Figure 5:
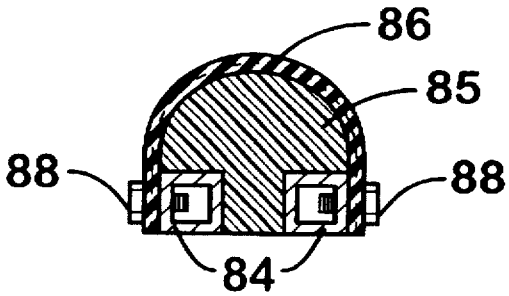
FIG. 5 is a sectional view taken along line 5—5 of FIG. 4.

Front frame 62 can be formed of a single tubular rectangular frame surrounding the working area. However, in the preferred embodiment, at least the sides of the tubular front frame are each formed of two parallel tubes as shown in FIG. 5. The two tubular sections serve to improve the rigidity of the front frame. This limits deflection when the frame is pressed against the ship hull to form a seal. A resilient core 85 formed of closed cell foam or other relatively stiff, resilient material is attached to tubes 84. A gum rubber cover sheet 86 encloses the closed cell foam core and is attached by suitable fasteners 88 to tubular members 84. The gum rubber cover 86 provides a durable and abrasive resistant exterior cover, while the closed cell foam provides a resilient, but more rigid structure that holds its shape.

In operation, the vacuum exhaust fan draws air at a rate of 4500 to 7500 and preferably 5000 to 6000 cubic feet per minute through the system. This creates a strong negative pressure in the enclosed dumpster and in the operator enclosure. The permeable inlet panel 28 in the top front of the enclosure provides a limited air inlet that directs air downwardly across the work surface to outlet conduit 36. The air inlet is sufficiently limited that the vacuum pump can maintain a strong negative pressure in the enclosure. This prevents dust from escaping from the enclosure and maintains a tight seal around the front of the frame. The inlet panel, however, permits enough airflow so the volume of air flow is great enough to draw all dust downwardly into the outlet conduit and then to the dust collector.

With a dumpster having a capacity of two cubic yards employed, the effect of this system is to reduce the air speed in the dumpster, so that the heavier particles (i.e., blast media) fall into the dumpster, while the lighter particles (paint, dust and the like) travel to the dust collector. Thus, the present system actually performs an air wash function that cleans the media (usually steel shot) for re-use. In systems that do not separate the media from the paint dust, the media is essentially non-reusable. Medial can be quite expensive. The advantage of reusing media can be a significant cost savings as well as a reduced disposal requirement.

While a particular embodiment of the invention has been shown, it will be understood of course, that the invention is not limited thereto, since modifications may be made by those skilled in the art, particularly in light of the foregoing teachings. Reasonable variations and modifications are possible within the scope of the foregoing disclosure of the invention without departing from the spirit of the invention.

The embodiments of the present invention in which an exclusive property or privilege is claimed are defined as follows:

1. Apparatus for grit blasting a working surface wherein the apparatus comprises:

a movable and adjustable boom having a distal end;

an enclosure for an operator comprising a platform enclosed by a top, sides, back, and bottom, and having an open front, the top, sides, back, and bottom being substantially air impermeable, the enclosure further comprising an air permeable panel near the open front and in an upper portion of the enclosure, the enclosure being mounted on the distal end of the boom for placement of the open front against the working surface;

abrasive blasting means for directing fluid impelled abrasive media stream onto the working surface through the open front of the enclosure; and a waste collection system that directs a high rate airflow stream, through the air permeable panel and downwardly across the working surface, entraining waste particles proximate to the working surface into the airflow stream, and then directs the air and waste particles to a sealed collection container below the enclosure, the waste collector system then drawing air and dust and lighter particulate material from the collection container to a dust removal apparatus before discharging the air.

2. Apparatus according to claim 1 wherein the enclosure comprises:

a rigid frame;

a substantially air impermeable cover covering sides and back of the frame;

a cover over a top of the frame, at least a portion of which is air permeable; and a substantially air impermeable bottom cover on a bottom of the frame, the bottom cover having downwardly and inwardly tapered sides and an outlet opening at a bottom thereof for the discharge of waste particles.

3. Apparatus according to claim 1 wherein the collection container is positioned below the enclosure and is connected to the enclosure outlet by a conduit, such that heavy particles are urged by gravity to fall into the collection container, the dust removal apparatus being positioned downstream of the collection container in sealed communication with a collection container outlet, the dust removal apparatus including a fan that draws air downwardly through the enclosure and then through the container to the dust removal apparatus, such that heavy particles remain in the container and lighter particles and dust are separated by a dust filter in the dust removal apparatus.

4. Apparatus according to claim 3 wherein the heavy particles comprise primarily steel blasting media, which settles in the container for re-use, the dust and lighter waste particles being entrained by the airflow to the dust collector where they are separated from the air by the dust collector filter.

5. Apparatus according to claim 1 wherein the enclosure further comprises:

a frame comprising a front frame describing the open front, the front frame being pivotally attached to a fixed position rear frame at an upper end of the front frame;

a flexible, substantially air impermeable cover covering the frame and extending between the frame and rear frame, permitting the front frame to be pivoted with respect to the rear frame between a retracted position and an extended position; and a mechanism accessible to a human operator to adjust and retain the front frame at any pivoted position between the fully retracted and fully extended position.

6. Apparatus according to claim 2 further comprising a seal about the open front of the enclosure, the seal comprising a natural or synthetic rubber sheet covering a less resilient core.

7. Abrasive blasting apparatus comprising:

a blasting enclosure having an open front, having a substantially air impermeable opposing back, having substantially air impermeable first and opposing second sides, having substantially air impermeable top and opposing bottom, having an air permeable panel, and having an enclosure outlet in the bottom, the air permeable panel being located near the open front and in an upper portion of the enclosure;

support means for supporting and positioning the enclosure in an elevated position above a surface with the open front opposite a working surface;

abrasive blasting means for conveying an abrasive blast media in a fluid stream to an outlet nozzle in the blasting enclosure, the outlet nozzle being directed out so as to direct blast media out of the open front of the enclosure against a working surface; and a waste collection apparatus comprising:

a sealed container positioned below the enclosure outlet and having an inlet in a removable top thereof and an outlet at an upper portion thereof;

a first conduit leading downwardly from the enclosure outlet to the container inlet, such that particulate material can fall by gravity from the enclosure outlet through the conduit to the container inlet;

a dust collector comprising a housing with an inlet and outlet and a blower that draws air in the inlet and discharges air from the outlet through a dust filter; and a second conduit connecting the dust collector inlet with the container outlet, such that operation of the dust collector blower draws air through the air permeable panel, across the worksurface and through the blasting enclosure, through the enclosure outlet, through the first conduit, through the container, through the second conduit, and thereafter causes the air to pass through the dust collector filter before discharging the air from the dust collector outlet, the waste collection apparatus being constructed such that dust and lighter particulate material are entrained in the air and drawn through the container and are filtered out in the dust collector, while the blasting media substantially settles out of the air stream in the container and is collected in the container, thereby separating the blasting media from a substantial portion of waste material.

8. Abrasive blasting apparatus according to claim 7 wherein the enclosure includes a peripheral seal around the open front that seals the open front against a working surface, the enclosure having an inlet in a top thereof, such that when the dust collector blower is operated the blower produces a negative pressure in the enclosure while at the same time providing a downward airflow over the worksurface from the enclosure inlet to the enclosure outlet, thereby urging dust and particulate material downwardly through the enclosure outlet to the container and dust collector.

9. Abrasive blasting apparatus according to claim 8 wherein the enclosure comprises a frame enclosed on all sides except the front side by a substantially impermeable cover, the inlet being a section of air permeable material in the cover.

10. Abrasive blasting apparatus according to claim 7 wherein the open front of the enclosure lies substantially in a plane, and the orientation of the plane of the open front is adjustable so that the open front can be made to be substantially parallel to portions of a working surface that are positioned in planes of varying orientation.

11. Abrasive blasting apparatus according to claim 10 wherein the enclosure comprises a frame covered with a flexible sheet material, the frame having a fixed position rear portion and a movable front portion lying in a plane and surrounding the open front of the enclosure, the front portion being movably attached to the rear portion such that the plane of the front portion can be adjusted to make the front portion fit flush against a working surface having a planar orientation that varies over its surface.

12. Abrasive apparatus according to claim 7 wherein:

the dust collector blower is a centrifugal vacuum blower that produces an airflow of at least 4500 cubic feet per minute;

the container is a dumpster with a sealed cover, the size of the dumpster and the positions of the inlets and outlet thereto being such that the airflow through the dumpster is sufficiently fast to carry dust and lighter debris particles through the dumpster, while the airflow rate is slow enough that steel blasting media particles will substantially settle from the air stream in the dumpster and remain therein; and the enclosure has a peripheral seal at the open front thereof that substantially seals the open front when it is placed flush against a working surface and a negative pressure is drawn in the enclosure by the dust collector blower, the enclosure having an inlet of limited size and permeability in a top surface thereof but otherwise being substantially impermeable, the size and permeability of the inlet being such that operation of the dust collector blower produces a negative pressure in the enclosure but permits the blower to draw air into the enclosure and downwardly across the working surface and then out of the enclosure through the enclosure outlet at a rate of at least 4500 cubic feet per minute.

13. Abrasive blasting apparatus according to claim 7 wherein the conduit connecting the enclosure outlet and the container inlet includes an axially collapsible section adjacent the container inlet and further comprising alignment means surrounding the container inlet and interconnected with the conduit that urges the conduit toward a collapsed condition, with the collapsible section remaining in axial alignment with the container inlet as it is collapsed.

14. An operator enclosure for an abrasive blasting apparatus wherein an operator positioned on a platform at the end of a movable boom directs a fluid impelled blasting media against a work surface from an operator controlled nozzle, the enclosure comprising:

a frame covered by a substantially air impermeable sheet material, the enclosure having a top and an opposing bottom, having opposing first and second sides, and having an open front and an opposing back, the sheet material including an air permeable panel near the open front and in an upper portion of the enclosure, the frame having a fixed position rear portion and a movable front portion pivotally attached to the fixed portion at an upper front edge thereof, with a lower end of the front portion being pivoted outwardly from the fixed portion of the frame, the frame further including adjustment means for adjustably holding the movable front portion of the frame in a desired pivotal position with respect to the fixed portion of the frame, the front portion of the frame having a seal surrounding the open front of the enclosure, the seal lying substantially in a plane; and a waste collection apparatus operatively connected with the enclosure bottom to draw a stream of air through the air permeable panel and across the work surface, entraining waste particles proximate to the work surface into the air stream, and out of the enclosure through the bottom.

* * * * *